United States Patent [19]

Ploppa et al.

[11] Patent Number: 4,715,198

[45] Date of Patent: Dec. 29, 1987

[54] CONTROL MAGNET ASSEMBLY FOR A PATTERN APPARATUS IN KNITTING MACHINES FOR ELECTRICALLY CONTROLLED NEEDLE SELECTION

[75] Inventors: Jürgen Ploppa, Pfullingen; Franz Schmid, Bodelshausen, both of Fed. Rep. of Germany

[73] Assignee: H. Stoll GmbH & Co., Fed. Rep. of Germany

[21] Appl. No.: 30,014

[22] Filed: Mar. 25, 1987

[30] Foreign Application Priority Data

Apr. 26, 1986 [DE] Fed. Rep. of Germany ..... 3614220

[51] Int. Cl.[4] ..... D04B 7/00

[52] U.S. Cl. ..... 66/75.2; 66/219; 66/232

[58] Field of Search ..... 66/75.2, 75.1, 219, 66/232

[56] References Cited

U.S. PATENT DOCUMENTS

| | | | |
|---|---|---|---|
| 3,974,664 | 8/1976 | Erb | 66/75.2 X |
| 4,030,319 | 6/1977 | Gloeckler | 66/75.2 |
| 4,081,974 | 4/1978 | Jaffe et al. | 66/75.2 |
| 4,320,635 | 3/1982 | Cucwe et al. | 66/75.2 X |
| 4,414,806 | 11/1983 | Schimko | 66/75.2 |
| 4,660,391 | 4/1987 | Schimko | 66/75.2 |

*Primary Examiner*—Ronald Feldbaum

*Attorney, Agent, or Firm*—Jones, Tullar & Cooper

[57] ABSTRACT

A control magnet assembly (10) for a pattern apparatus in knitting machines, for electrically controlled needle selection, has selection magnets (29, 30), which are provided with permanent magnetic retaining pole zones and with control pole zones with which control coils (42, 43; 52, 53) that are triggerable in accordance with the pattern are associated, and against which armature elements (26) operatively connected with the needles (18) can be brought. In a control magnet assembly (10) of this kind, optimal magnetic conditions in the control pole zone are to be provided such that a uniform and reliable throwing off of the appropriate armature elements (26) is always attained. To this end, a measuring head (15, 25) is provided for detecting the magnitude of the magnetic field in the control pole zone, and a circuit layout is provided between the measuring head (15, 25) and the control coil (42, 43, 52, 53).

15 Claims, 5 Drawing Figures

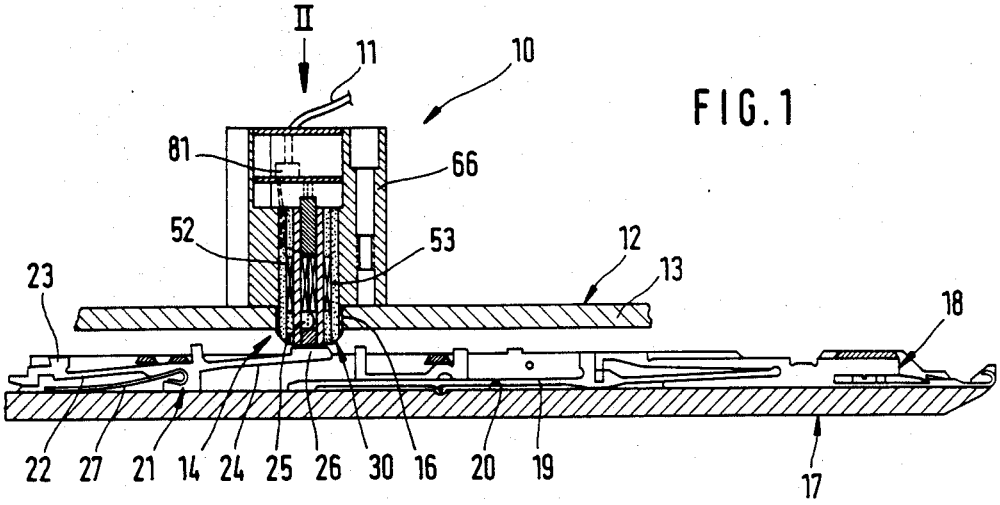
FIG. 1
FIG. 5
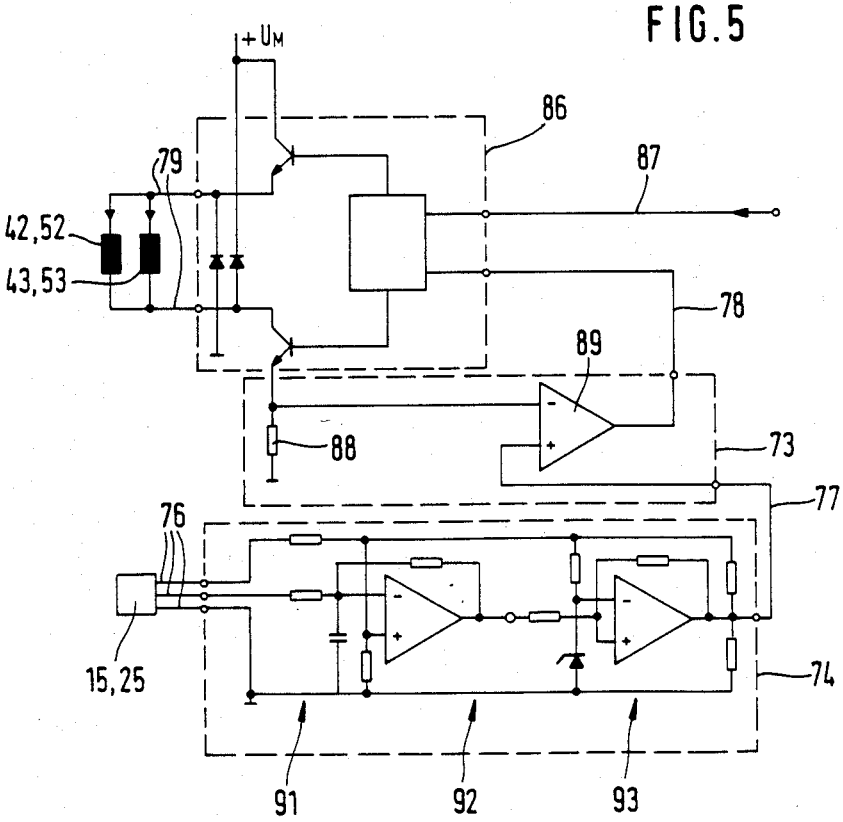

CONTROL MAGNET ASSEMBLY FOR A PATTERN APPARATUS IN KNITTING MACHINES FOR ELECTRICALLY CONTROLLED NEEDLE SELECTION

FIELD OF THE INVENTION

The present invention relates to a control magnet assembly for a pattern apparatus in knitting machines for electrically controlled needle selection. The control magnet assembly has at least one selection magnet, which is provided with at least one permanent magnet retainer pole zone and at least one control pole zone, with which at least one control coil, which is triggerable in accordance with the pattern, is associated, and against which armature elements that are operatively connected to the needles can be moved.

BACKGROUND OF THE INVENTION

In control magnet assemblies of this kind, which are known in both flat-bed knitting machines and circular knitting machines (for example, see German Auslegeschrift No. 15 85 206, German Patent No. 20 10 973, German Offenlegungschrift No. 21 50 360 and German Offenlegungschrift No. 25 19 896), a variably large number of armature elements are retained on the selection magnet, in accordance with the triggering by the pattern apparatus in the through travel direction following the control pole zone. These armature elements form magnetic short-circuits with respect to the armature element that at a given time is actually in the control pole zone. As a result the retaining force with which that particular armature element is retained in the control pole zone is varied, and hence also the magnitude of the counter field that is to be built up relative to the permanent magnetic field, so as to reduce the retaining force to zero or to the vicinity of zero in the control pole zone for "throwing off" an armature element. In other words, the magnetizing current to be expanded to generate the counterforce and which is to flow through the control coils is dependent in its magnitude on how many armature elements remain attracted immediately previously. The fewer armature elements continue to adhere, the greater must the magnetizing current be that must flow through the control coil. This problem arises to an even greater extent in multi-system knitting machines or selection magnet systems, because the neighboring pole zones "throw off" in various ways. The same applies to flat-bed knitting machines, in contrast to circular knitting machines; in circular knitting machines, armature elements are always presented, while in the case of flat-bed machines this is not the case in the stroke reversal zones, where quite variable magnetic conditions therefore prevail.

In the known control magnet assemblies, optimal throwing off by the particular armature elements does not take place because the magnetic counterforce generated by the always-constant magnetizing flow through the control coil may possibly be too large or too small, which in either case can cause an armature element that should be thrown off to remain stuck. Although it is known from German Offenlegungschrift No. 21 50 360 to provide the selection magnet with an adjustable magnetic shortcircuit, nevertheless all this means is that manufacturing tolerances and material deviations which affect the magnetic circuit can be compensated for. The above-described problem or disadvantage still exists, however.

OBJECT AND SUMMARY OF THE INVENTION

It is an object of the present invention to provide an improved control magnet assembly for a pattern apparatus in knitting machines for electrically controlled needle selection of the above generic type such that optimal magnetic conditions in the control pole zone are furnished in such away that uniform and reliable throwing off of the particular armature elements is always attained.

This object is attained, in a control magnet assembly as described above, by providing a measuring head for detecting the magnitude of the magnetic field in the control pole zone and by providing a circuit layout between the measuring head and the control coil.

Since the measuring head can measure the instantaneous magnetic field intensity in the control pole zone at any time, the value of this magnetic field intensity being used via the circuit layout for determining the optimal countermagnetization, the retaining force can always be brought accurately to the predetermined value, for instance zero, for throwing off following armature elements, regardless of the number of existing short circuits caused by adhering armature elements. As a result, uniform dropping off is attained for all the armature elements, without the danger that one or another armature element that should be thrown off will stick. An always constant and accurate compensation for the existing permanent magnetic field in the control pole zone for throwing off of armature elements is thus assured. At the same time, any manufacturing tolerances and differences in the properties of the material that affect the magnetic circuit or circuits are also compensated for.

The measuring head may inherently be embodied by arbitrary elements for measuring the field intensity. Suitably, however, a Hall generator is used for the measuring head, because such an element is a reliable and small-sized component.

In order to obtain the most accurate possible measurement of the field intensity in the control pole zone, the measuring head is disposed near the control pole zone pole face opposite the armature elements.

From German Offenlegungschrift No. 21 50 360 it is known to provide pole pieces on both sides of the selection magnet, with the ends of the pole pieces that have the pole faces leaving a gap open between them. In an exemplary embodiment of the present invention, this gap between the pole pieces in the vicinity of the ends is utilized for accommodating the measuring head, by displacing the measuring head in the gap formed between the pole ends. This also provides an optimal disposition of the measuring head. It is also suitable for the measuring head to be set back with respect to the pole faces and to dispose a nonmagnetic strip of hard material in the qap, adjoining the measuring head, the free end face of this strip protruding somewhat beyond the pole faces. As a result the measuring head is not only brought close to the pole faces, but central guidance of the particular armature elements is also provided.

According to the present invention it is also advantageous to surround each of the pole pieces with a control coil, both control coils being triggerable in parallel uniformly in the same direction, so that on both sides of the measuring head and of the nonmagnetic strip an identical magnetic field, in the opposite direction from the permanent magnetic field, is generated. The effective inductance is also reduced thereby, resulting in a quick rise in current and thus in an accelerated and improved control (that is, more-rapid compensation for the permanent magnet field).

In another exemplary embodiment of the present invention, the circuit layout has a control circuit, which is coupled to a comparator circuit having a measuring resistor connected in series with the control coil or coils; the output of the comparator circuit is equal to the difference between the voltage derived from the magnetizing current at the measuring resistor and the Hall voltage. As a result, very simple regulation based on the pertinent comparison is attained. This circuit layout also makes it possible to apply a relatively high feed voltage $U_M$ of 40 V for instance, so that by this means as well very short current rise times and thus a very rapid compensation for the permanent magnet field are attainable. This circuit layout is also short-circuit-proof if there is a defective sensor or even if there is no sensor at all.

The control circuit suitably has an adjustable level adaptation circuit, by means of which calibration, based on manufacturing tolerances and deviations due to the particular design, can be attained before the apparatus is placed in service.

It is suitable if both the selection magnet and those parts of the circuit layout that serve to calibrate the magnetic system are received by a circuit board and disposed inside a common housing. If the housing is detachably secured to the front panel of the cam carriage, then this component unit can be removed and replaced as a unit, without requiring further assembly work and calibration operations.

If the control magnet assembly for a multi-system knitting machine is provided with a number of selection magnets corresponding to the number of needle selection systems, then it is particularly advantageous if a common permanent magnet is used for the permanent-magnetic retaining pole zones of the selection magnets.

Further details of the invention will become apparent from the ensuing detailed description of an exemplary embodiment shown in the drawings.

BRIEF DESCRIPTION OF THE DRAWINGS

FIG. 1 is a longitudinal section taken through a needle bed of a flat-bed knitting machine and a control magnet assembly, located movably above this needle bed, in accordance with a preferred exemplary embodiment of the present invention;

FIG. 5 is a schematic diagram of a circuit layout such as is used in the control magnet assembly according to the invention.

DESCRIPTION OF THE PREFERRED EMBODIMENT

Figure 2:
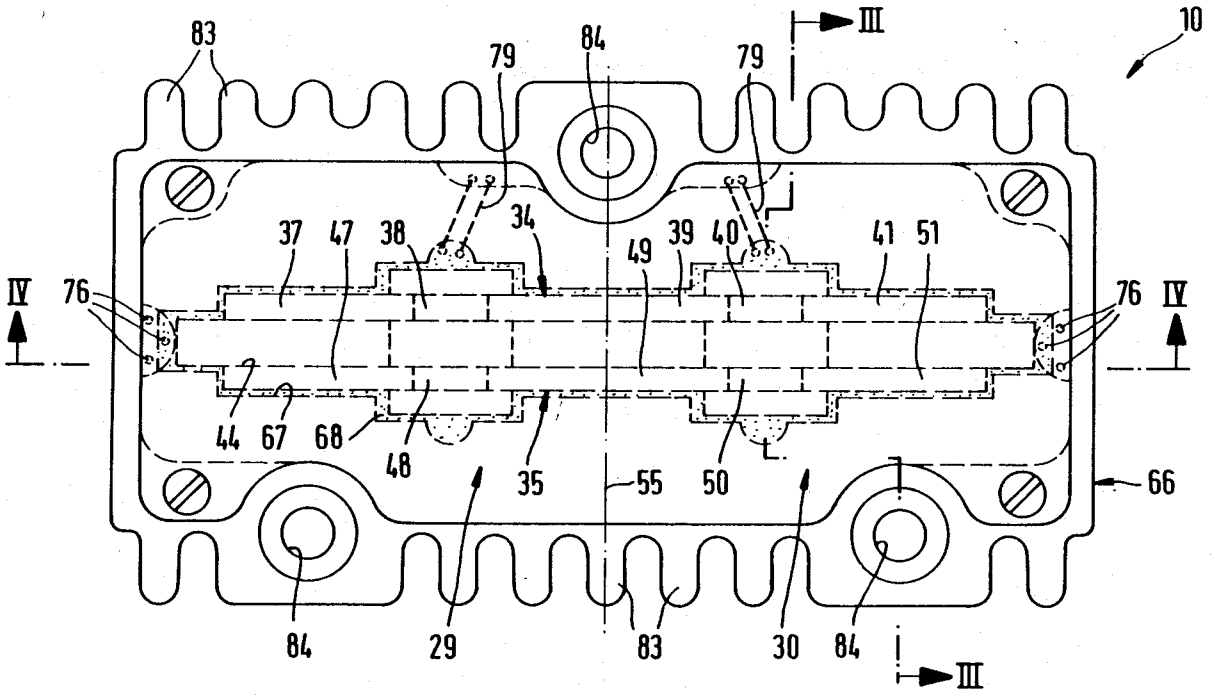
FIG. 2, on a larger scale, is a plan view of the control magnet assembly in the direction of the arrow II in FIG. 1.

The control magnet assembly 10 shown in the drawings, in accordance with a preferred exemplary embodiment of the present invention, which is connected via a control cable 11 to a pattern apparatus, not shown, of a flat-bed knitting machine, is secured to the back side of a front panel 13 of a carriage 12 not shown in detail, and a head portion 14, in this case containing two measuring heads 15, 25, which penetrates the front panel 13 through a slit-like recess 16 and protrudes beyond the front side, facing a needle bed 17, on the front panel 13. The carriage 12 provided with the control magnet assembly 10 is movable back and forth along the needle bed 17, in which a multiplicity of knitting needles 18 are supported in needle slots 20 such that they are movable back and forth (to the left and right as seen in FIG. 1) crosswise to the direction of carriage travel. The needles 18 are connected in a manner not shown in detail to a needle pusher 19, which can be acted upon by a selection jack 21. The selection jack 21 is substantially embodied as a two-armed lever, and is held movably in the direction of movement of the needles 18 in the needle slot 20 associated with the particular knitting needle 18. The selection jack 21 is mounted pivotably on the bottom of the needle slot 20, has a butt 23 on its rearward arm, remote from the needle pusher 19, and an armature element 26 of magnetic material on its forward arm 24, oriented toward the needle pusher 19. The rearward arm 22 of the selection jack 21 is acted upon by a leaf spring 27 such that the selection jack 21 in the position of repose is pivoted away so that its armature element 26 is located inside the needle slot 20 and its rearward butt 23 is located outside the needle slot 20.

In the usual manner, upon the transit of the carriage 12, the selection jacks 21 are pivoted counter to the action of the leaf spring 27 (as shown in FIG. 1) by means of cams, not shown, disposed on the carriage 12 and are thus presented to the control magnet assembly 10 and are held thereby in the presented position, and upon further movement of the carriage 12 are either retained further or let loose or "thrown off", by reduction of the magnetic retention force to zero, so that the particular selection jacks 21 can move into their position of repose, under the influence of the leaf spring 27. In the exemplary embodiment, in this position of repose, the selection jack 21 and thus the associated knitting needle 18 is selected, because it is movable toward the needle pusher 19, by means of a feeder element secured to the carriage and on which the butt 23 comes to rest, so that the needle 18 can be moved into a working position.

Figure 3:
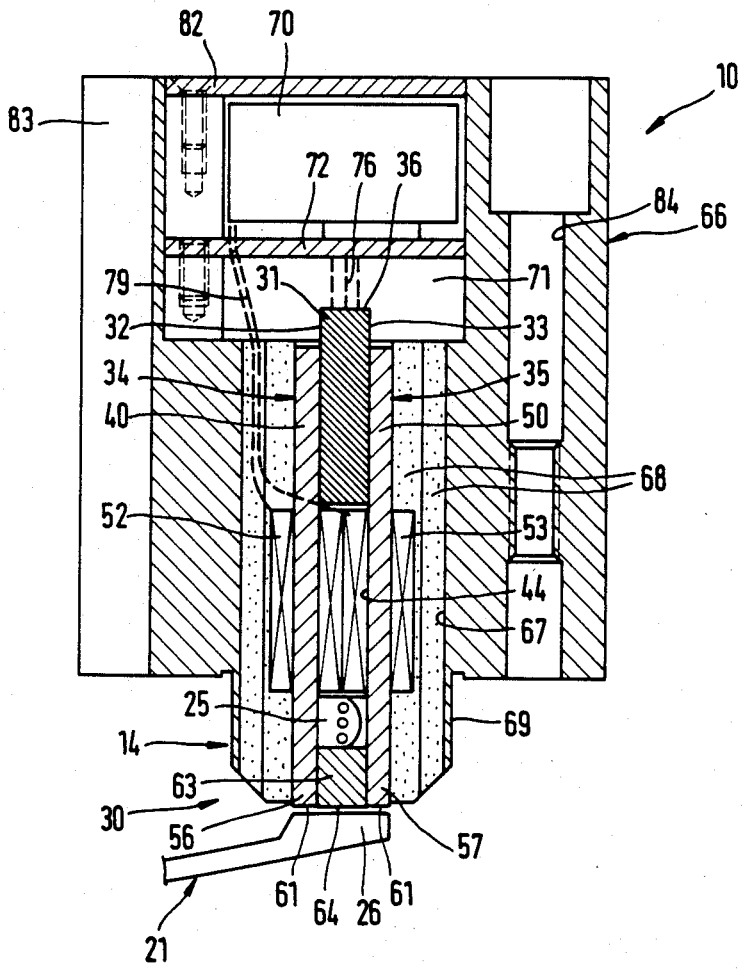
FIG. 3 is a longitudinal section, selected in accordance with FIG. 1, taken through the control magnet assembly along the line III—III of FIG. 2.
Figure 4:
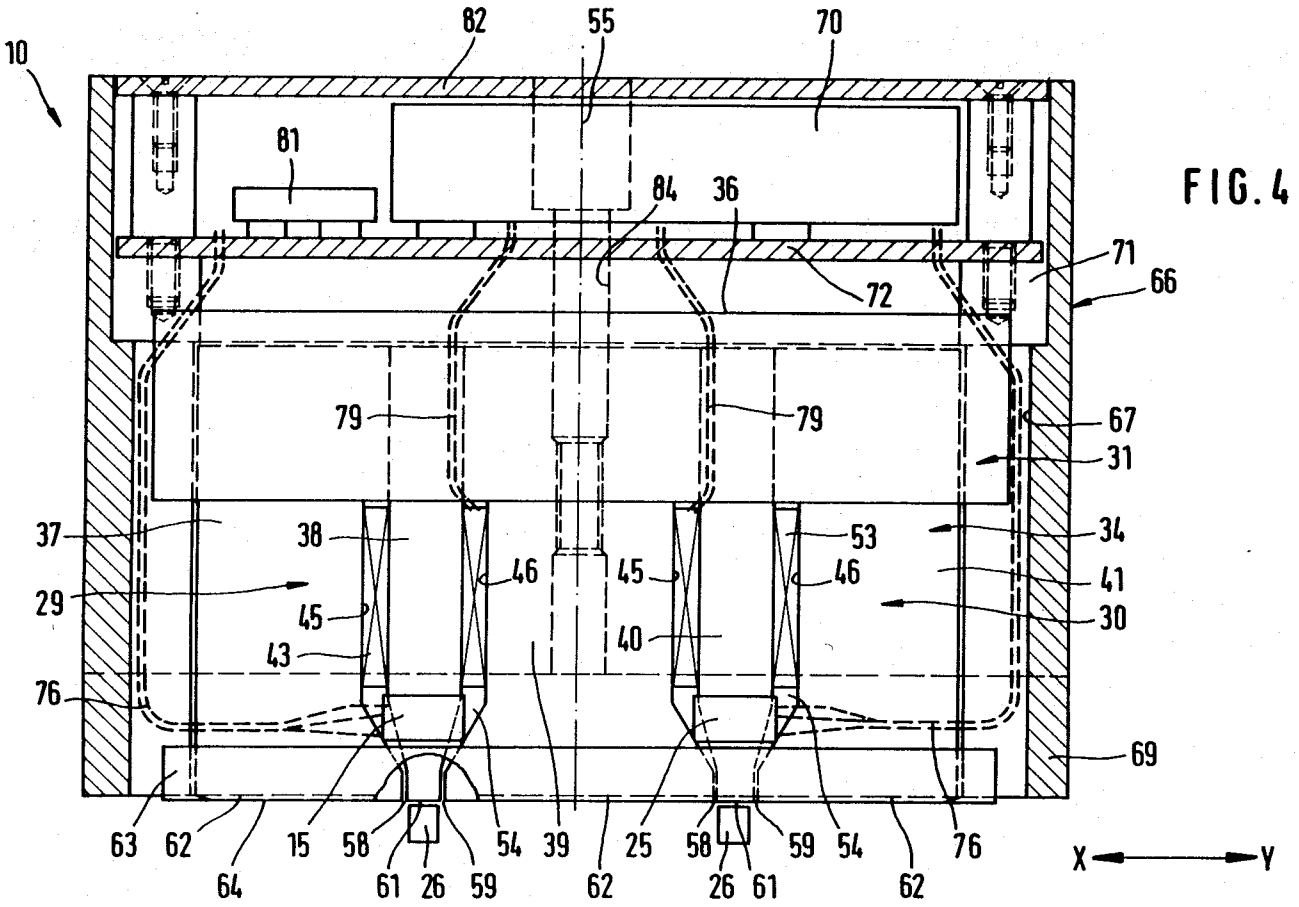
FIG. 4 is a section rotated by 90° as compared with FIG. 3 through the control magnet assembly along the line IV—IV of FIG. 2.

The control magnet assembly 10, according to the exemplary embodiment of FIGS. 2—4, has two selection magnet systems 29 and 30 which come into action in succession and which together have a strip-like permanent magnet 31, which extends oriented longitudinally upright on both wide side faces 32, 33 of the permanent magnet 31, pole pieces 34, 35 extend and rest in platform-like fashion. While in the longitudinal extension of the permanent magnet 31 the two pole pieces 34 and 35 protrude only slightly at both ends, in the direction of the transverse extension of the pole pieces 34 and 35 are substantially wider than the permanent magnet 31, although the upper long side 36 of the permanent magnet 31 protrudes somewhat beyond the upper long sides of the pole pieces 34, 35. Viewed in the longitudinal direction, the pole pieces 34 and 35 are divided into a plurality of elements 37–41 and 47–51 (see FIG. 2), which as shown in FIG. 4 are each separated from one another by a small gap. Reference numerals 37, 47 or 39, 49 or 41, 51, for pole pieces 34 and 35, identify the outer (on the left in FIG. 2) or inner or outer (on the right of FIG. 2) retaining pole piece elements of the pole pieces 34 and 35, that is, those which define the retaining pole zones of the two selection magnet systems 29, 30 of the control magnet assembly 10. In contrast, referenece numerals 38, 48 and 40, 50 designate the control pole piece elements of the pole pieces 34 and 35, that is, those which define the control pole zones of the two selection magnet systems 29, 30 of the control magnet assembly 10. The retaining pole piece elements and the control pole piece elements are identical among themselves, the control pole piece elements being substantially narrower than the retaining pole piece elements. A division of the control magnet assembly 10 into the two selection magnet systems 29 and 30 is effected by the plane 55 shown in FIGS. 2 and 4. The control pole piece elements 38 and 48 or 40 and 50 are each surrounded by a control coil 42 and 52 or 43 and 53. The control coils 42, 52 and 43, 53 are located with their top surfaces spaced apart by a short distance from and facing the lower long side of the permanent magnet 31 and across a further portion of the widthwise extension of the pole pieces 34, 35 as far as the head portion 14. The control coils 42 and 52 or 43 and 53 each belonging to one pair of the control pole piece elements 38 and 48 or 40 and 50 facing one another are wound in the same direction and substantially fill up the gap 44, formed with approximately the same thickness as the permanent magnet 31, between the two pole pieces 34 and 35 (FIG. 3) and the gap 44 or 46 with respect to the adjoining retaining pole piece elements 37, 47 or 39, 49 or 41, 51 (FIG. 4). The gaps 45, 46 between the retaining pole piece elements and the control piece elements taper as shown in FIG. 4 and in the vicinity of the ends 56 and 57 of the pole pieces 34 and 35 disposed in the head portion 14 form a very small air gap 58 or 59, which are offset inward and parallel with respect to the gaps 45 and 46. The control pole piece elements are thus narrower in the vicinity of their free ends than in the vicinity surrounded by the control coils, so that in the direction of travel X or Y of the carriage 12, narrow control pole face sections 61 result, corresponding to the thickness of the armature element 26. In the same plane as the control pole face sections 61 are the retaining pole face sections 62, which are defined by the retaining pole piece elements.

Displaced in the head portion 14 of the control magnet assembly 10, on the lower side of the corresponding pair of control coils 42, 52 or 43, 53 and in the gap 44 between the associated two control pole piece elements of the pole pieces 34 and 35 of each selection magnet system 29, 30 is the measuring head 15 or 25 for measuring the magnetic field intensity in each of the control pole zones. The measuring head 15, 25 is a Hall generator, in the preferred exemplary embodiment of the present invention shown. It will be understood that other elements which measure the magnetic field intensity may also be used. The Hall generator 15, 25 is disposed in the respective intermediate zone 54 along which the gaps 45, 46 taper to the air gaps 58 and 59. Immediately adjacent to the underside of the measuring head 15, 25, a slide strip 63 is provided in the gap 44, which comprises a hard material such as sapphire and along the sliding face 64 of which the armature elements 26 of the selection jacks 21 slide. The sliding strip 63 has approximately the same length as the permanent magnet 31 and is likewise embodied in one piece. Its sliding face 64 protrudes beyond the pole face sections 61 and 62 by a slight amount, for example 0.05 mm, so that a correspondingly small air gap is formed between the armature elements 26 and the pole faces 61, 62.

The two selection magnet systems 29 and 30, forming a unit, are inserted into a rectangular recess 67 of a housing 66, with an interposed elastic filling composition 68. In the vicinity of the recess 67, the housing 66 has an extension 69 on its open front side, in the form of two parallel side walls in which the head portion 14 of the two selection magnets 29 and 30 is received. Adjoining the rectangular recess 67, remote from the extension 69, is a wider, approximately rectangular hollow space 71, which is subdivided by means of a circuit board 72 that is detachably secured in the hollow space 71. The circuit board 72, with components shown in the form of boxes 70 in FIGS. 3 and 4, forms a control circuit 74 for each selection magnet system 29, 30; this control circuit 74 is connected, in a manner shown in greater detail in FIG. 5, via lines 76, 77, 78 and 79 to the respective measuring head 15 or 25, to the respective control poles 42, 43 or 52, 53 and to a level control circuit 86 and a comparator circuit 73, which are for example accommodated in a cabinet next to the machine. The circuit board 72 also carries a plug-in bushing 81, into which the cable 11, for example for both selection magnet systems, leading to the pattern apparatus and to the circuits 73, 86 can be plugged. The hollow space 71 is covered by a detachably secured cap 82. The substantially approximately rectangular housing 66 has cooling fins 83 on its long sides. The housing 66 is secured via connecting screws that are inserted into bores 84 to the front panel 13 of the cam carriage 12 such that it is detachable from outside, so that it is replaceable on its own, as a component containing the selection magnet systems, without requiring further assembly or disassembly.

From FIG. 5, the circuit layout of the control magnet assembly 10 according to the invention, having the electrical circuits 73, 74, 86, can be seen. Each pair of control coils 42 and 52 or 43 and 53 is connected in parallel with one another and near the trigger circuit 86, which is supplied with direct current $U_M$ (of 40 V, for example), is connected to the pattern apparatus, not shown, of the knitting machine for the pattern-dependent triggering via a line 87. Connected to the trigger circuit 86 is the comparator circuit 73, which contains a measuring resistor 88 and a voltage comparator 89, one input of which is connected to the measuring resistor 88, the other input of which is connected to the control circuit 74, and the output of which is connected to the trigger circuit 86. The control circuit 74, which on its output side is connected to the comparator circuit 73, is connected on its input side to the associated measuring head or Hall generator 15, 25. The control circuit 74 contains an adjustable calibration element 91, an adjustable amplifier and level adaptation element 92 and a threshold value limiting element 93, which are connected in series. Thus each selection magnet can be calibrated and adjusted on its own, regardless of where it is used.

The function of the control magnet assembly 10 according to the invention is as follows: If a presented armature element 26 of a selection jack 21, after sliding along the retaining pole zone of a selection magnet system 29 or 30, is supposed to be "thrown off" in the control pole zone of this system, then in accordance with the pattern a magnetizing current is supplied to the appropriate control coil pair, such that a magnetic field is built up very rapidly in the control pole zone, this field being opposite to the permanent magnet field in the control pole zone and having the same magnitude, so that the magnetic retaining force is reduced to a predetermined value that is less than the force of the leaf spring 27 acting upon the selection jack 21. Preferably the magnetic retaining force should be reduced to zero. In order to attain this value for the resultant magnetic retaining force accurately, regardless of how many of the selection jacks preceding this selection jack 21 that is to be thrown off are sticking to the following retaining pole zone, the instantaneously prevailing field intensity is measured in the control pole zone by means of the field intensity sensor 15 or 25, embodied as a Hall generator, and processed in the control circuit 74 and delivered to the input of the comparator circuit 73. The comparator circuit 73 is also supplied with the magnetizing voltage picked up at the measuring resistor 88, which is proportional to the magnetizing current supplied to the control coil pair. The differentiating output of the comparator circuit 73 determines the magnetizing current to be supplied to the pair of control coils, and this current is the input signal for the trigger circuit 86. If the difference between the two voltages to be compared is greater than zero, then the magnetizing current is increased until because of the reduction of the magnetizing field intensity the differential output is equal to zero. In this process, a triggering of the associated pair of control coils takes place by means of the trigger circuit 86 only whenever a trigger signal arrives in accordance with the pattern via the line 87.

It will be understood that one suitable electrical circuit layout is associated with each selection magnet 29 or 30, each of which is triggered separately in accordance with the pattern. It will also be understood that the control magnet assembly 10, in the event that instead of a two-system knitting machine, a onesystem machine is being used, will have only one selection magnet 29 or 30. Correspondingly, with multi-system arrangements a plurality of selection magnets may also be secured as a unit on a carriage 12, and preferably one common permanent magnet is provided (this is known as the three-way technique).

What is claimed is:

1. A control magnet assembly for a pattern apparatus in knitting machines for electrically controlled needle selection by controlling the armature element of selection jacks of the knitting machine operatively associated with the needles, comprising:

at least one selection magnet system having at least one permanent magnet retainer pole zone and at least one control pole zone, with said at least one control pole zone having a control coil associated therewith which is energized in accordance with the selection pattern;

a measuring head for detecting the magnitude of the magnetic field of the control pole zone; and a circuit layout situated between the measuring head and the control coil for controlling the magnetic field of the control pole zone.

2. The control magnet assembly as defined in claim 1, wherein the measuring head comprises a Hall generator.

3. The control magnet assembly as defined in claim 1, wherein the control pole zone defines a control pole face, and wherein the measuring head is disposed near the control pole face opposite an armature element.

4. The control magnet assembly as defined in claim 1, wherein said at least one selection magnet system further has spaced apart pole pieces which define a gap therebetween, and wherein the measuring head is disposed in said gap near the ends of the pole pieces adjacent to the armature element.

5. The control magnet assembly as defined in claim 4, further comprising:

a non-magnetic strip, wherein the pole pieces define pole faces which face the armature element, and wherein the nonmagnetic strip is disposed in said gap between the measuring head and the armature element, said non-magnetic strip defining a free face which extend outward from the pole faces of the pole pieces.

6. The control magnet assembly as defined in claim 4, wherein each pole piece is surrounded by a control coil, said control coils being energized uniformly and parallel in the same direction.

7. The control magnet assembly as defined in claim 1, wherein the circuit layout comprises a control circuit and a comparator circuit connected to the control circuit, the comparator circuit having a measuring resistor connected in series with said control coil, the output of said comparator circuit being equal to the difference between the voltage derived from the magnetizing current of the measuring resistor and the Hall voltage at the measuring head.

8. The control meagnet assembly as defined in claim 7, wherein the control circuit has an adjustable level adaptation circuit.

9. The control magnet assembly as defined in claim 7, wherein the control circuit has a threshold and limiter circuit.

10. The control magnet assembly as defined in claim 8, wherein the control citcuit has a threshold and limiter circuit.

11. The control magnet assembly as defined in claim 1, further comprising:

a housing open on one side for receiving said at least one selection magnet system; and a circuit board also received within said housing and located above said at least one selection magnet system, said circuit board receiving at least part of the citcuit layout.

12. The control magnet assembly as defined in claim 11, further comprising:

a removable cap provided for said housing to close said housing on said one side.

13. The control magnet assembly as defined in claim 11, wherein said housing is provided with cooling fins.

14. The control magnet assembly as defined in claim 11, wherein the housing is detachably secured to the front panel of the cam carriage of the knitting machine.

15. The control magnet assembly as defined in claim 1, further comprising:

a permanent magnet, wherein a plurality of selection magnet systems are provided with the permanent magnet serving as a common permanent magnet for the plurality of selection magnet systems.

* * * * *